US009773478B2

(12) United States Patent
Deering

(10) Patent No.: US 9,773,478 B2
(45) Date of Patent: Sep. 26, 2017

(54) WHITE OAK BANJO

(71) Applicant: Deering Banjo Company, Inc., Spring Valley, CA (US)

(72) Inventor: Charles Greg Deering, El Cajon, CA (US)

(73) Assignee: Deering Banjo Company, Inc., Spring Valley, CA (US)

( * ) Notice: Subject to any disclaimer, the term of this patent is extended or adjusted under 35 U.S.C. 154(b) by 0 days.

(21) Appl. No.: 15/275,642

(22) Filed: Sep. 26, 2016

(65) Prior Publication Data

US 2017/0092237 A1 Mar. 30, 2017

Related U.S. Application Data

(60) Provisional application No. 62/233,895, filed on Sep. 28, 2015.

(51) Int. Cl.
*G10D 1/10* (2006.01)

(52) U.S. Cl.
CPC ..... *G10D 1/10* (2013.01)

(58) Field of Classification Search
CPC ..... G10D 1/10; G10D 1/02
See application file for complete search history.

(56) References Cited

U.S. PATENT DOCUMENTS

2005/0223870 A1* 10/2005 Passafiume ..... G10D 1/10 84/269
2012/0227569 A1* 9/2012 Koks ..... G10D 13/028 84/413
2017/0025101 A1* 1/2017 Mankel, III ..... G10D 3/06

* cited by examiner

*Primary Examiner* — Kimberly Lockett
(74) *Attorney, Agent, or Firm* — Richard D. Clarke

(57) ABSTRACT

The present invention is directed to a banjo with all the wooden parts made from White Oak with the elimination of the conventional metal tone ring reducing the weight and lowering the manufacturing costs. As a result, white oak vibrates at a higher frequency and does not absorb as much of the sound vibrations as other woods so the tone is richer and louder.

20 Claims, 4 Drawing Sheets

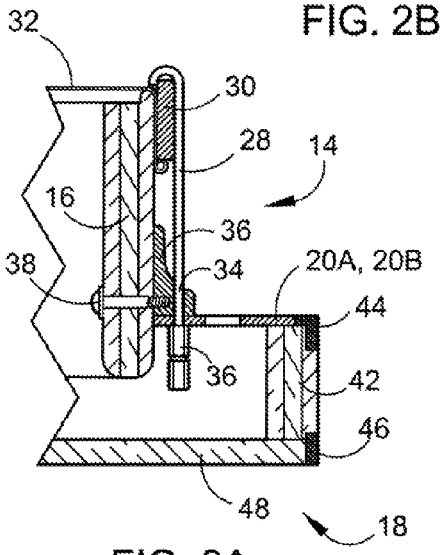
FIG. 2A
FIG. 2B
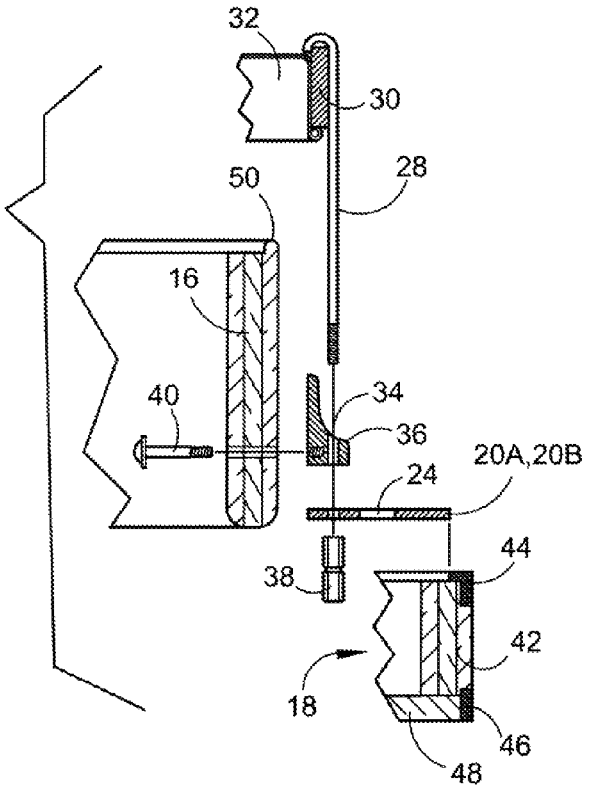
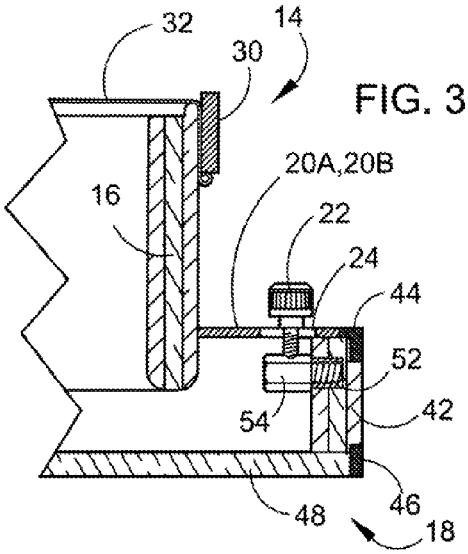
FIG. 3A
FIG. 3B
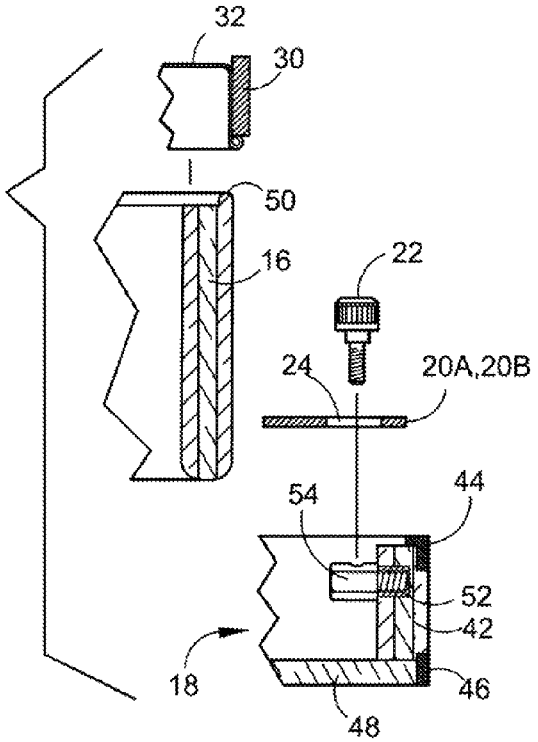

WHITE OAK BANJO

FIELD OF THE INVENTION

The present invention is directed to a new and unique construction of the banjo more particularly to the elimination of the conventional metal tone ring and making the banjo of White Oak.

BACKGROUND OF THE INVENTION

The banjo is usually associated with country, folk, classical music, Irish traditional music and bluegrass music. Recently, the banjo has enjoyed inclusion in a wide variety of musical genres, including pop crossover music, indie rock and Celtic punk where entertainers are freely moving around and sometimes dancing.

Banjos essentially consist of a neck and body, with a plurality of tensioned strings strung across both the neck and body, supported by a bridge and secured at each end. The body consists of a banjo head attached to a resonant tone chamber. The conventional banjo head consists of a drum head material stretched over a tone ring by the means of a tension hoop.

A banjo player strums or plucks the strings, causing the drum head to vibrate. There are open back Banjos and Banjos with a resonant tone chamber. Traditional banjos are largely made from a combination of metallic and wood parts, and as a result, are quite heavy. By reducing the number of metal parts and using a lighter weight wood the instrument becomes much lighter. With the unique configuration of the top edge of the banjo body or drum the tone ring can be eliminated. The tone ring is the heaviest metal part of most Banjos and by eliminating it the Banjo becomes much more manageable.

The inventor has found that American white oak has desirable qualities in the manufacturing process. White oak is a domestic renewable resource that is light brown with paler sapwood; strong, tough, fine-grained and durable. Specific gravity, 0.7470; weight of one cubic foot, 46.35 lbs. and 20% lighter than Mahogany, Walnut or Curley Maple. White Oak is a harder wood and has longer grains, longer fibers and so it has more structural stability. As a result, white oak vibrates at a higher frequency and does not absorb as much of the sound vibrations as other wood types so the tone is louder. White oak responds to higher frequencies and so bass frequencies are very clear because of the density of the wood. Both aspects are key to great banjo tone and replace the need for a tone ring saving 28% of the weight of a banjo with a traditional tone ring design. White Oak is a hugely popular hardwood for kitchens, furniture, flooring, and interior joinery manufacture. It has a strong visible grain and is relatively free of defects. Boards are available sold Kiln Dried from Eastern United States and Canada.

The Sierra® Maple banjo (Sierra is a registered trademark of the Deering Banjo Company, Inc.) is about 11.74 lbs. and the White Oak banjo is about 8.36 lbs. which is equal to about 28% less than the weight of the Sierra Maple banjo. By eliminating the tone ring and using white oak there is an improvement in the sound quality where white oak produces a brighter tone and a very sonar bass. It has a very "growly," clear bass response producing about two to four decibels of increased volume, while significantly reducing the manufacturing costs over the Sierra® Maple banjo.

Numerous innovations for the Banjo have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the White Oak Banjo and the prior art.

U.S. Pat. No. 8,816,176 of Bruce J. Kunkel describes a banjo, made almost entirely of wood, eliminates most metal parts of a traditional banjo. The neck is bolted to the body, improving sustain. The body consists of a drum assembly bolted to a resonant tone chamber. The resonant tone chamber consists of a thin back, thin rim assembly, interior flange ring, thin decorative cover and tone ring. The interior flange ring provides mechanical strength to the resonant tone chamber and anchors the drum assembly. The drum assembly consists of a banjo head and a tension hoop. The banjo head snugly fits over the tone ring, and is tensioned via a plurality of bolts that secure the tension hoop in the drum assembly to the flange ring in the resonant tone chamber. A sound port cut into the rim assembly provides sound to a player. Sound holes cut into the decorative cover project sound from the resonant tone chamber toward an audience.

This patent describes a banjo, made almost entirely of wood, that eliminates most metal parts of a traditional banjo in a conventional manner but is still using a tone ring.

US Patent Application Publication No. 2006/0011041 of James Sidney Barrett describes a Banjo with a Wood Ring Alteration that alters the five string banjo's wooden ring (rim) by drilling a series of 64 holes in the ring structure at various diameters, depths and locations. This is performed on standard size wooden banjo rings.

This patent describes a Banjo with a Wood Ring Alteration that alters the five string banjo's wooden ring but still uses a conventional tone ring.

None of these previous efforts, however, provides the benefits attendant with the White Oak Banjo. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of this application in detail it is to be understood that the design is not limited in its application to the details of construction and to the arrangement of the components set forth in the following description or illustrated in the drawings. The White Oak Banjo is capable of other embodiments and of being practiced and carried out in various ways. In addition, it is to be understood that the phraseology and terminology employed herein are for the purpose of description and should not be regarded as limiting.

SUMMARY OF THE INVENTION

The principal advantage of the White Oak Banjo is eliminating the tone ring and reducing the weight of the conventional Banjo.

Another advantage is that white oak is 20% lighter weight than the Mahogany, Walnut or Curley Maple woods that are normally used in the fabrication of Banjos.

Another advantage is the top outside edge of the white oak laminated drum section extends up to create a rounded pressure ridge of about 0.125 to about 0.187 inches wide against the drum skin.

Another advantage is that white oak vibrates at a higher frequency and does not absorb as much of the sound vibrations as other types (other tree species) of woods.

Another advantage of the White Oak Banjo is that it produces increased audio volume by about two to four decibels over a similarly constructed conventional banjo.

Another advantage of the White Oak Banjo is the reduced cost of manufacturing.

Another advantage of the White Oak Banjo is that it is made from White Oak that is a domestic hardwood grown in the United States, and a renewable resource.

The resonator style of White Oak Banjo consists of the banjo body and neck portions. The body consists of the laminated drum, the resonator, and two ornamental flanges attached by the means of four threaded mounting shoulder screws. The laminated drum can be fabricated from two or more laminations with three being the preferred fabrication process. The four threaded mounting shoulder screws go through four elongated orifices to secure the resonator to the laminated drum of the drum body. Around the perimeter of the two ornamental flanges are a series of decorative orifices that transmit the sound from the resonator.

By using White Oak wood it produces a brighter tone and a very sonar bass. It has a very growly, clear bass response. It is a harder wood and has longer grains, longer fibers and so it has more structural stability. As a result, white oak vibrates at a higher frequency and does not absorb as much of the sound vibrations as other woods so the tone is louder. White Oak responds to higher frequencies and so bass frequencies are very clear because of the density of the wood. Both aspects are key to great banjo tone and replace the need for a tone ring saving 28% of the weight of a traditional tone ring design while producing an audio from two to four decibels of increased volume. The Serra Maple banjo is about 11.74 lbs. and the White Oak banjo is about 8.36 lbs. which is equal to about a 28% decrease of the weight when compared to the Sierra Maple banjo.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the White Oak Banjo. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the White Oak Banjo and together with the description, serve to explain the principles of this application.

FIG. 2A depicts a cross section of the banjo body and drum portion at one of the J-hook locations.

FIG. 2B depicts an exploded cross section of the banjo body and drum portion at one of the J-hook locations.

FIG. 3A depicts a cross section of the banjo body and drum portion at one of the mounting point attachments of the ornamental flange to the resonator section.

FIG. 3B depicts an exploded cross section of the banjo body and drum portion at the mounting point attachment of the ornamental flange to the resonator section.

For a fuller understanding of the nature and advantages of the White Oak Banjo, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
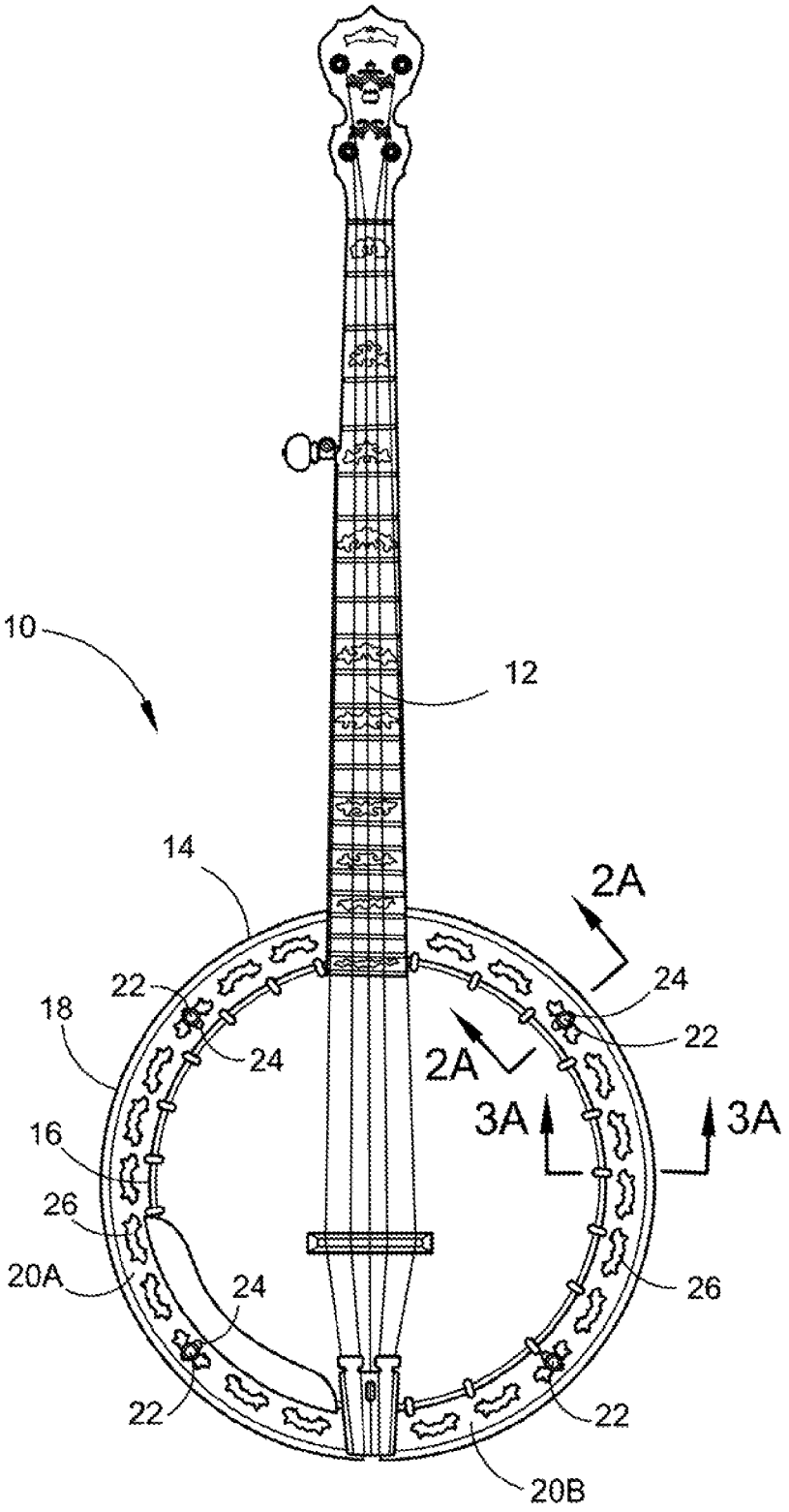
FIG. 1 depicts a front plan view of the resonator style of White Oak Banjo.

Referring now to the drawings, wherein similar parts of the White Oak Banjo 10 are identified by like reference numerals, there is seen in FIG. 1 a front plan view of the resonator style of White Oak Banjo 10 illustrating the banjo neck 12 and banjo body 14. The White Oak Banjo 10 can be manufactured in the resonator style or the open back style and still be within the scope of this application.

The banjo body 14 consists of the laminated drum 16, the resonator 18, and the two ornamental flanges 20A and 20B attached by the means of four threaded mounting shoulder screws 22. The laminated drum 16 can be fabricated from two or more laminations with three being the preferred fabrication process. The four threaded mounting shoulder screws 22 go through four elongated orifices 24 to secure the resonator 18 to the laminated drum 16 of the drum body 14. Around the perimeter of the two ornamental flanges 20A and 20B are a series of decorative orifices 26 that transmit the sound out of the resonator 18.

FIG. 2A depicts a cross section of the banjo body 14 and laminated drum 16 at one of the J-hook 28 locations. The J-hook 28 is illustrated over the tension ring 30 that secures the drum skin 32 tightly over the laminated drum 16. The J-hook 28 extends down through an orifice 34 of the wall lug 36 and through the ornamental flanges 20A or 20B to be tightened by the means of an extension nut 38. The wall lugs 36 are attached to the laminated drum 16 by the means of the screws 40. The ornamental flanges 20A and 20B seat into top surface of the resonator 18 having laminated vertical member 42 that has polymer corner insets 44 and 46 with the bottom pan 48 attached.

FIG. 2B depicts an exploded cross section of the banjo body 14 and laminated drum portion 16 at one of the J-hook 28 locations. The J-hook 28 is illustrated over the tension ring 30 that secures the drum skin 32 tightly over the laminated drum portion 16. The top outside edge of the laminated drum 16 extends up to create a rounded pressure ridge 50 of about 0.125 to about 0.187 inches wide. The J-hook 28 extends down through orifice 34 of the wall lug 36 and through the ornamental flanges 20A and 20B to be tightened by the means of an extension nut 38. The wall lugs 36 are attached to the laminated drum 16 by the means of the screws 40. The ornamental flanges 20A and 20B seat into the resonator 18 composed of the laminated rim 42 that have the polymer corner insets 44 and 46 with the bottom pan 48 attached.

FIG. 3A depicts a cross section of the banjo body 14 and laminated drum portion 16 at one of the mounting point attachments of the ornamental flanges 20A and 20B to the resonator 18. The threaded mounting shoulder screws 22 goes through the elongated orifices 24 to secure the resonator 18 to the laminated drum 16 of the drum body 14 by the means of the threaded insert 52 in the laminated drum portion 16 and the drum attachment lug 54.

FIG. 3B depicts an exploded cross section of the banjo body 14 and the laminated drum 16 at the mounting point attachments of the ornamental flanges 20A and 20B to the resonator 18.

Figure 4:
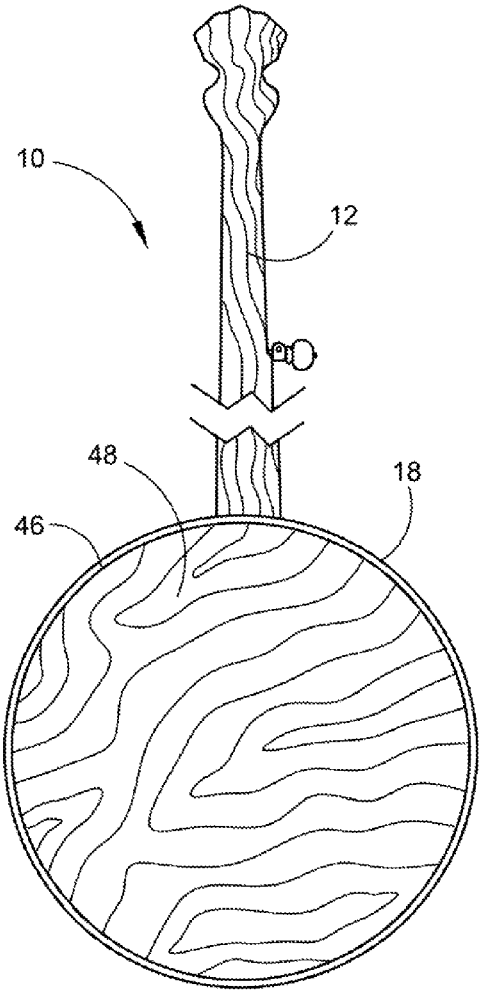
FIG. 4 depicts a rear plan view of the White Oak Banjo.

FIG. 4 depicts a rear plan view of the White Oak Banjo 10 illustrating the banjo neck 12, the lower corner polymer inset 46 and the bottom pan 48 of the resonator 18.

Figure 5A:
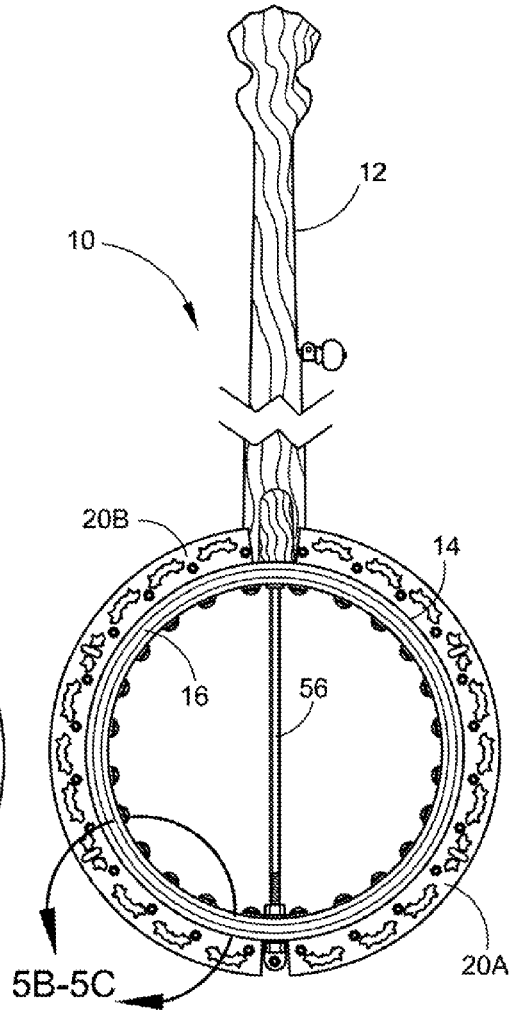
FIG. 5A depicts a rear plan view of the White Oak Banjo with the resonator section removed.

FIG. 5A depicts a rear plan view of the White Oak Banjo 10 with the resonator 18 removed, depicting the laminated drum 16 with the ornamental flanges 20A and 20B. The coordinator rod 56 extends across the center of the laminated drum 16 to secure the banjo neck 12 and to increase the strength of the laminated drum 16 from the tension exerted by the instruments strings.

Figure 5B:
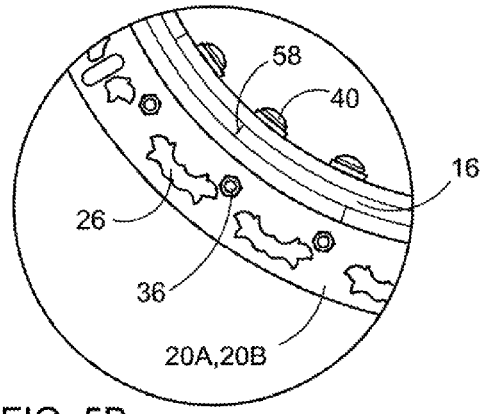
FIG. 5B depicts a detail drawing of a banjo laminated drum wall segment illustrating the butted laminated wall fabrication.

FIG. 5B depicts a detail drawing of a laminated drum 16 wall segment illustrating the laminated butted joint 58 wall fabrication.

Figure 5C:
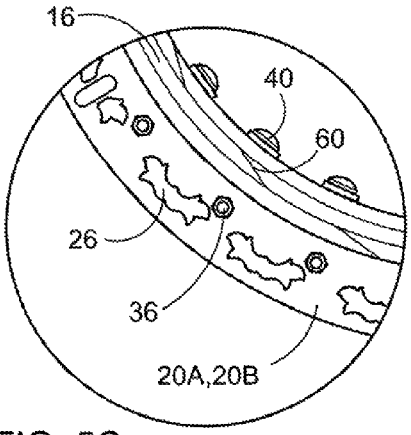
FIG. 5C depicts a detail drawing of a banjo laminated drum wall segment illustrating the scarfed laminated wall fabrication.

FIG. 5C depicts a detail drawing of a banjo laminated drum 16 wall segment illustrating the laminated scarfed joint 60 laminated wall fabrication with an increased gluing surface.

Figure 6:
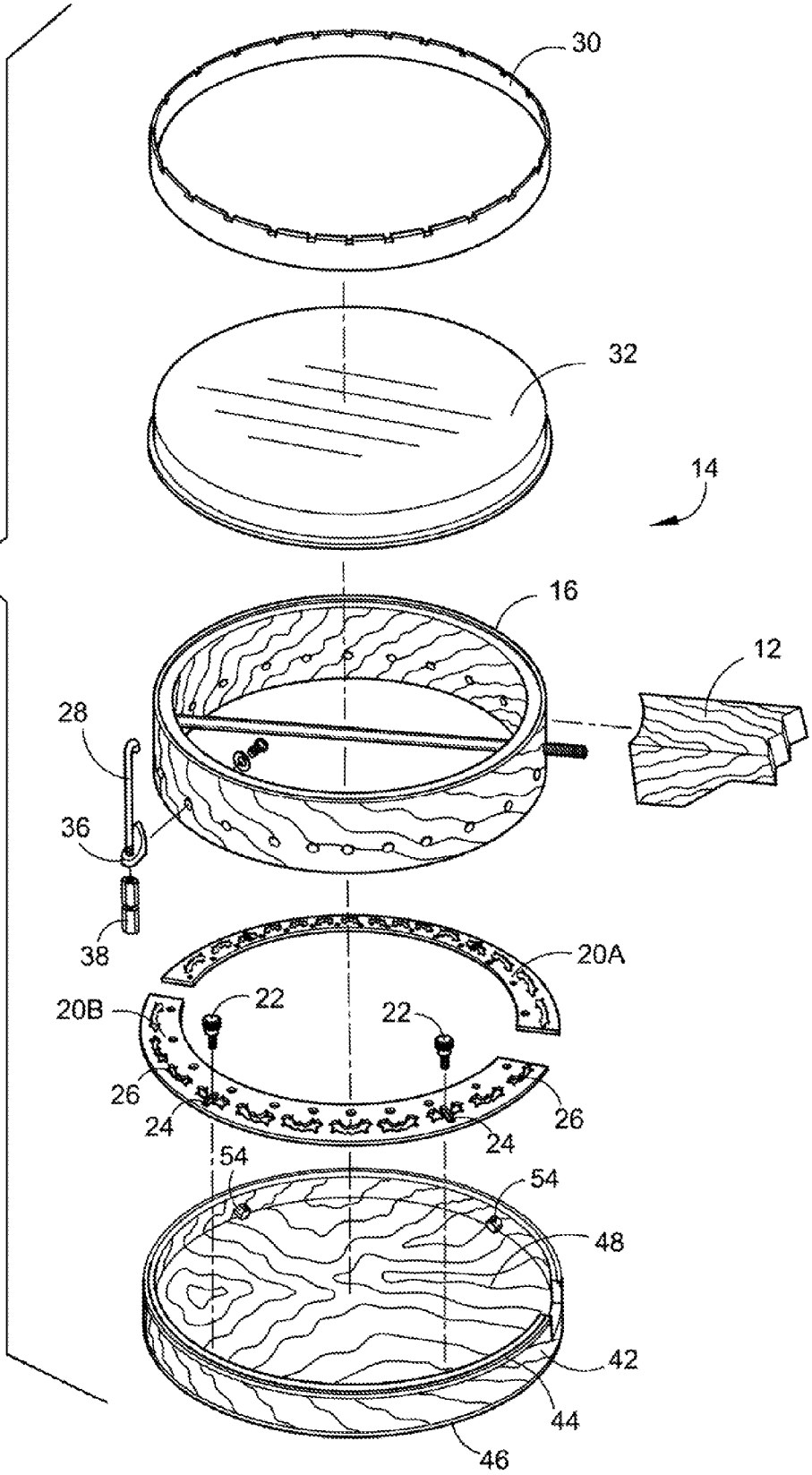
FIG. 6 depicts an exploded view of the banjo body fabrication.

FIG. 6 depicts an exploded view of the banjo body 14 fabrication with the tension ring 30 above the drum skin 32. The laminated drum 16 illustrates the location of the coordinator rod 56 to the banjo neck 12 and the J-hook 28 and wall lug 36 locations. Two separate ornamental flanges 20A and 20B are shown above the resonator 18 section.

The White Oak Banjo 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a White Oak Banjo 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A stringed musical instrument comprising:

a banjo neck component; and a banjo drum component;

a banjo resonator assembly, wherein said banjo resonator assembly further includes a banjo resonator made of only white oak wood and said banjo resonator assembly includes one or more ornamental flanges;

wherein said banjo drum component is constructed using only the material white oak wood, thereby eliminating the requirement of a conventional metal tone ring and resulting in the reduction of the overall weight of the stringed musical instrument.

2. A stringed musical instrument according to claim 1, further wherein said banjo drum component constructed using only the material white oak wood, is constructed of a solid piece of white oak wood.

3. A stringed musical instrument according to claim 1, further wherein said banjo drum component constructed using only the material white oak wood, is constructed of laminated white oak wood sections.

4. A stringed musical instrument according to claim 3, further wherein said laminated white oak wood sections are laminated using a butt join lamination.

5. A stringed musical instrument according to claim 3, further wherein said laminated white oak wood sections are laminated using a scarf join lamination.

6. A stringed musical instrument according to claim 1, wherein said banjo drum component has a front side and a back side and further wherein said banjo drum component has an open back side.

7. A stringed musical instrument according to claim 1, wherein said banjo drum component and said banjo resonator assembly further includes a banjo bottom pan component wherein said banjo bottom pan component is constructed using only the material white oak wood.

8. A stringed musical instrument according to claim 7, wherein said banjo resonator includes a banjo bottom pan component, and said bottom pan component further includes one or more polymer insets.

9. A stringed musical instrument according to claim 7, wherein said banjo drum component having a banjo bottom pan component further includes a resonator assembly made of only white oak wood.

10. A stringed musical instrument according to claim 7, wherein said banjo drum component having a banjo bottom pan component further includes a resonator made of white oak wood and a plurality of metal fasteners, and said resonator includes one or more ornamental flanges secured in place with said metal fasteners.

11. A method for making a stringed musical instrument comprising the steps of:

a) providing a banjo drum component constructed using only the material white oak wood;

b) providing a banjo neck component;

(c) providing a banjo resonator assembly, wherein said banjo resonator assembly further includes a banjo resonator made of only white oak wood and said banjo resonator assembly includes one or more ornamental flanges; and (d) attaching said banjo neck component to said banjo drum component;

wherein said banjo drum component is constructed using only the material white oak wood, thereby eliminating the requirement of a conventional metal tone ring and resulting in the reduction of the overall weight of the stringed musical instrument.

12. The method for making a stringed musical instrument according to claim 11, further wherein said banjo drum component constructed using only the material white oak wood, is constructed of a solid piece of white oak wood.

13. The method for making a stringed musical instrument according to claim 11, further wherein said banjo drum component constructed using only the material white oak wood, is constructed of laminated white oak wood sections.

14. The method for making a stringed musical instrument according to claim 13, further wherein said laminated white oak wood sections are laminated using a butt join lamination.

15. The method for making a stringed musical instrument according to claim 13, further wherein said laminated white oak wood sections are laminated using a scarf join lamination.

16. The method for making a stringed musical instrument according to claim 11, wherein said banjo drum component has a front side and a back side and further wherein said banjo drum component has an open back side.

17. The method for making a stringed musical instrument according to claim 11, wherein said banjo drum component and said banjo resonator assembly further includes a banjo bottom pan component wherein said banjo bottom pan component is constructed using only the material white oak wood.

18. The method for making a stringed musical instrument according to claim 17, wherein said banjo resonator assembly includes a banjo bottom pan component, and said bottom pan component further includes one or more polymer insets.

19. The method for making a stringed musical instrument according to claim 17, wherein said banjo drum component having a banjo bottom pan component further includes a resonator assembly made of only white oak wood.

20. The method for making a stringed musical instrument according to claim 17, wherein said banjo drum component having a banjo bottom pan component further includes a banjo resonator assembly made of white oak wood and a plurality of metal fasteners, and said resonator includes one or more ornamental flanges secured in place with said metal fasteners.

* * * * *